US006758919B2

(12) United States Patent
Milligan

(10) Patent No.: US 6,758,919 B2
(45) Date of Patent: Jul. 6, 2004

(54) CAST STEEL COMPOSITION FOR RAILWAY COMPONENTS

(75) Inventor: Bruce A. Milligan, Pataska, OH (US)

(73) Assignee: Columbus Steel Castings Co., Columbus, OH (US)

( * ) Notice: Subject to any disclaimer, the term of this patent is extended or adjusted under 35 U.S.C. 154(b) by 0 days.

(21) Appl. No.: 10/157,090

(22) Filed: May 29, 2002

(65) Prior Publication Data

US 2003/0047247 A1 Mar. 13, 2003

Related U.S. Application Data

(63) Continuation of application No. 09/633,992, filed on Nov. 8, 2000, now abandoned, which is a continuation-in-part of application No. 09/233,753, filed on Jan. 20, 1999, now abandoned.

(60) Provisional application No. 60/072,357, filed on Jan. 23, 1998.

(51) Int. Cl.[7] ..... C22C 38/22; C22C 38/24

(52) U.S. Cl. ..... 148/328; 148/334; 148/335

(58) Field of Search ..... 148/328, 334, 148/335, 581, 320; 420/108, 111

(56) References Cited

FOREIGN PATENT DOCUMENTS

| | | | |
|---|---|---|---|
| JP | 58-1059 | * 1/1983 | ..... C22C/38/12 |
| JP | 9-324241 | * 12/1997 | ..... C22C/38/00 |

* cited by examiner

*Primary Examiner*—Deborah Yee
(74) *Attorney, Agent, or Firm*—Banner & Witcoff, Ltd.

(57) ABSTRACT

A high strength steel alloy for use in manufacturing railway car components. The alloy has a chemical composition that meets the industry required specifications for B grade steel and exhibits better mechanical properties, such as higher yield and tensile strengths. Secondary benefits of the inventive steel alloy include enhanced weldability and improved fatigue resistance.

5 Claims, No Drawings

CAST STEEL COMPOSITION FOR RAILWAY COMPONENTS

This application claims the benefit of priority of U.S. Provisional Application No. 60/072,357, filed Jan. 23, 1998. This application is a continuation of U.S. application Ser. No. 09/633,992, filed Nov. 8, 2000, which was continuation-in-part of U.S. application Ser. No. 09/233,753, filed Jan. 20, 1999, both of which are now abandoned.

FIELD OF THE INVENTION

The present invention relates in general to cast steel alloys for railway car components. More specifically, but without restriction to the particular use which is shown and described, this invention relates to an improved Grade B steel composition for use in manufacturing railway car components.

BACKGROUND OF THE INVENTION

The Association of American Railroads ("A.A.R.") sets forth guidelines requiring manufactured railway components, for example, truck bolsters, side frames, couplers, yokes and draft arms, to satisfy certain mechanical and chemical properties. Consistent with the needs of the railroad industry, the A.A.R. enumerates standards for the chemical composition ranges and the minimum mechanical properties of cast steel railcar components. Some of these steel standards for railcar components are classified broadly into the following categories: Grade A, Grade B, or Grade C steel. For Grade B steel, for example, the A.A.R. requires the following maximum chemical properties: Carbon 0.32%; Manganese 0.90% (Mn 1.20% when using the carbon reduction allowance); Silicon 1.50%; Phosphorus 0.04%; and Sulfur 0.04%. The A.A.R. also requires for Grade B steel the resulting composition to exhibit the following mechanical properties: Ultimate Tensile Strength 70 KSI; Yield Strength 38 KSI; Elongation 24.0%; Reduction of Area 36.0%; and Charpy Impact values of 15 ft-lbs minimum at +20° F. These chemical and mechanical properties for Grade B steel are the minimally tolerable requirements for this grade of steel for the railway parts, assemblies and components manufactured under the A.A.R. specifications. However, depending on the application and customer needs, it is often desirable for Grade B steel railway components with improved strength and enhanced weldability. To this end, other alloys may be added to the above constituent alloy components to enhance the overall performance of the steel and still meet the A.A.R. minimum requirements.

SUMMARY OF THE INVENTION

Accordingly, an object of the present invention is to provide an enhanced Grade B steel for casting railcar components, such as truck bolsters and side frames, which meets the A.A.R. chemical specifications for Grade B steel yet exhibits better overall mechanical properties.

Briefly stated, the present invention involves a cast steel alloy which has the following chemical composition, by weight %: Carbon 0.18 to 0.25%; Manganese 0.90 to 1.10%; Phosphorus 0.02% (maximum); Sulfur 0.015% (maximum); Silicon 0.30 to 0.60%; Nickel 0.50% (maximum); Chromium 0.20 to 0.35%; Molybdenum 0.08 to 0.12%; Aluminum 0.03 to 0.08%; Vanadium 0.08 to 0.12%; and residual components, such as, Calcium 0.0 to 1.0 lb per ton. In the normalized state, the resulting composition exhibits the following mechanical properties: Ultimate Tensile Strength 85 KSI (minimum); Yield Strength 50 KSI (minimum); Elongation 24.0% (minimum); Reduction of Area 36.0% (minimum) and Brinell Hardness range 137–208. The aforementioned chemical composition satisfies the A.A.R. specifications for Grade B steel and exhibits better mechanical properties, such as higher yield and tensile strengths. The resulting composition also exhibited Charpy Impact values that meet the A.A.R. Grade B minimum of 15 ft-lbs at +20° F. while having the higher yield and tensile strengths. Secondary benefits of the inventive steel composition include better weldability The full range of objects, aspects and advantages of the invention are only appreciated by a full reading of this specification and a full understanding of the invention. Therefore, to complete this specification, a detailed description of the invention and the preferred embodiments follow.

DESCRIPTION OF THE INVENTION

Referring to Tables 1 and 2, there is shown, in summary, the A.A.R. specification of the minimally tolerable chemical composition and mechanical requirements, respectively, for Grade B steel for use in railcar components:

TABLE 1

| Grade | C | Mn | Si | P | S |
|---|---|---|---|---|---|
| B | 0.32 max | 0.90 max | 1.50 max | 0.04 max | 0.04 max |

TABLE 2

| Grade | Tensile Strength (psi) | Yield Point (psi) | Elongation (%) | Reduction of Area (%) |
|---|---|---|---|---|
| B | 70,000 | 38,000 | 24 | 36 |

In an exemplary embodiment of the present invention for use with casting of railway car components, the chemical composition ranges of the preferred steel alloy is set forth in the table below:

CHEMICAL COMPOSITION RANGES

| C | Mn | P | S | Si | Ni | Cr | Mo | Al | V |
|---|---|---|---|---|---|---|---|---|---|
| 0.18 | 0.90 | — | — | 0.30 | — | 0.20 | 0.08 | 0.03 | 0.08 |
| 0.25 | 1.10 | 0.02 | .015 | 0.60 | 0.50 | 0.35 | 0.12 | 0.08 | 0.12 |

Fe and inevitable impurities make up the balance of the preferred composition. In addition to the above chemical constituents, Calcium may be added up to a maximum of one pound per ton. The preferred chemical composition exhibits the following mechanical properties which exceed the A.A.R. requirements for the railway car applications:

MECHANICAL PROPERTIES

| Ultimate Tensile Strength (KSI) | Yield Strength (KSI) | Elongation (%) | Reduction of Area (%) | Brinell Hardness Range |
|---|---|---|---|---|
| 85 | 50 | 24.0 | 36.0 | 137–208 |

Significantly, the above steel meets the A.A.R. Grade B steel minimum Charpy Impact value of 15 ft-lbs at +20° F.

and exhibits better mechanical properties, such as, higher tensile and yield strengths. To complement these enhanced mechanical properties, is the lower carbon content of 0.18 to 0.25% and the smaller alloy additions, which result in a steel that offers enhanced weldability over known steel compositions meeting Grade B requirements. The steel alloy of the present invention is made from a normalized heat treatment process that results in an alloy having a ferrite and perlite grain microstructure. Normalizing is a heat treatment process consisting of heating uniformly to temperature above the critical range and cooling in still air at room temperature. This heat treatment process results in the ferrite and perlite microstructures which provide the mechanical properties of the present invention while also improving the weldability characteristics of the alloy.

This steel alloy also has a finer grain structure as compared to a plain carbon steel, which is normally used to fulfill Grade B specifications. The finer grain structure is believed to be beneficial to certain mechanical properties such as fatigue resistance. The steel alloy of the present invention also forms carbide particles that are very hard, which in turn, pin the grain boundaries in place during heating resulting in less grain growth.

In the foregoing specification, the present invention has been described with reference to specific exemplary embodiments thereof. It will be apparent to those skilled in the art, that a person understanding this invention may conceive of changes or other embodiments or variations, which utilize the principles of this invention without departing from the broader spirit and scope of the invention. The specification and drawings are, therefore, to be regarded in an illustrative rather restrictive sense.

What is claimed is:

1. A high strength steel alloy for railway car components consisting of:

an alloy having a composition consisting of 0.18 to 0.25% C, 0.90 to 1.10% Mn, 0.30 to 0.60% Si, 0.20 to 0.35% Cr; 0.08 to 0.12% Mo, 0.03 to 0.08% Al, 0.08 to 0.12% V, a maximum of 0.02% P, a maximum of 0.015% S, a maximum of 0.50% Ni, and the balance Fe and inevitable impurities, whereby the alloy is heat treated by uniformly heating the alloy above the alloy critical temperature and then cooling the alloy in still air at room temperature, and whereby the alloy has a fine microstructure primarily comprising ferrite and perlite, and forms hard carbide particles that pin grain boundaries in place during heating resulting in less grain growth.

2. The high strength steel alloy of claim 1 wherein the alloy further includes a residual component of Ca.

3. The high strength steel alloy of claim 1 wherein the alloy has a minimum tensile strength of 85 ksi and a minimum yield strength of 50 ksi.

4. The high strength steel alloy of claim 1 wherein the alloy has an elongation of 24%.

5. The high strength steel alloy of claim 1 wherein the alloy has a reduction of area of 36%.

* * * * *